US007837032B2

(12) United States Patent
Smeltzer

(10) Patent No.: US 7,837,032 B2
(45) Date of Patent: Nov. 23, 2010

(54) GOLF BAG HAVING MAGNETIC POCKET

(75) Inventor: Bryan Smeltzer, Coto de Caza, CA (US)

(73) Assignee: Gathering Storm Holding Co. LLC, Carlsbad, CA (US)

( * ) Notice: Subject to any disclaimer, the term of this patent is extended or adjusted under 35 U.S.C. 154(b) by 102 days.

(21) Appl. No.: 11/847,324

(22) Filed: Aug. 29, 2007

(65) Prior Publication Data

US 2009/0057179 A1 Mar. 5, 2009

(51) Int. Cl.
*A63B 55/02* (2006.01)
*A45C 13/10* (2006.01)

(52) U.S. Cl. ..... 206/315.5; 206/818; 24/303; 150/117; 190/111; 190/902; 383/38

(58) Field of Classification Search ..... 206/315.3, 206/818, 315.4, 315.6–315.9; D3/255; 24/303; 224/901, 653, 655; 190/103, 111, 903; 150/159, 150/117; 383/38, 97

See application file for complete search history.

(56) References Cited

U.S. PATENT DOCUMENTS 1,845,088 A * 2/1932 Hunerhoff ..... 206/315.5
3,008,209 A * 11/1961 Kurt ..... 24/303
3,827,019 A * 7/1974 Serbu ..... 335/285
3,938,570 A 2/1976 Stewart
4,706,856 A * 11/1987 Jacober ..... 224/153
4,925,021 A * 5/1990 Pulichino, Jr. ..... 206/279
5,176,253 A * 1/1993 Perrin et al. ..... 206/315.5
5,222,598 A * 6/1993 Yamazoe ..... 206/315.5
5,749,447 A * 5/1998 Hersh et al. ..... 190/112
5,765,691 A * 6/1998 Hall ..... 206/579
5,865,314 A * 2/1999 Jacober ..... 206/570
5,908,132 A * 6/1999 Pigeon ..... 220/484
6,119,742 A 9/2000 Maeng
6,202,723 B1 3/2001 Maeng
6,224,537 B1 * 5/2001 Shin ..... 600/9
6,301,754 B1 * 10/2001 Grunberger et al. ..... 24/303
6,328,191 B1 12/2001 Conley
6,330,944 B1 * 12/2001 DeMichele ..... 206/315.3
D493,033 S * 7/2004 Howe, Jr. ..... D3/255
7,021,459 B2 * 4/2006 Puskaric ..... 206/315.6
7,111,731 B2 9/2006 Pratt et al.
7,361,097 B2 4/2008 Hot
2002/0113105 A1 8/2002 Jarman
2003/0146126 A1 * 8/2003 Kanter et al. ..... 206/503
2005/0016648 A1 1/2005 Vakharia et al.
2006/0011499 A1 * 1/2006 Yen ..... 206/315.3
2006/0112523 A1 * 6/2006 Deto et al. ..... 24/303

(Continued)

*Primary Examiner*—Sue A Weaver
(74) *Attorney, Agent, or Firm*—Tsircou Law, P.C.

(57) ABSTRACT

A golf bag is provided that includes a bag body and a golf bag having a pocket that includes magnetic assemblies that cooperate with one another to hold the pocket together in a closed configuration. In addition, the pocket is configured to close itself without need of any additional manipulation by the user. The pocket can further include first and second edges aligned with one another defining an opening for a compartment accessible on a bag body of the golf bag. The pocket can further include first and second magnetic assemblies disposed along the first and the second edges. The first and the second magnetic assemblies can each include a plurality of magnets. For example, the magnetic assemblies can each include a sleeve that confines the plurality of magnets in end-to-end, spaced-apart relationship.

17 Claims, 8 Drawing Sheets

U.S. PATENT DOCUMENTS

2006/0201596 A1 9/2006 Hwang
2007/0158005 A1* 7/2007 Mangano ..... 150/127
2007/0193902 A1* 8/2007 Myers et al. ..... 206/320
2007/0214613 A1* 9/2007 Shiao ..... 24/303

* cited by examiner

GOLF BAG HAVING MAGNETIC POCKET

FIELD OF THE INVENTION

The present invention relates generally to golf bags and, more particularly, golf bags having a storage pockets.

BACKGROUND OF THE INVENTION

Golf bags house golf clubs and accessories for convenient access during play. Golf bags are typically designed as elongated structures designed to receive golf clubs, having an open top end and a closed base, such that the club heads extend out the top of the bag. This enables convenient identification and selection of clubs during play. Golfers take the golf bag around the course with them, whether walking the course or using a golf cart.

Golf bags typically also include one or more compartments for storing golf accessories such as golf balls, tees, ball markers, and golf gloves, as well as a golfer's other personal items. Commonly, golf bag compartments are accessible from the side of the golf bag and include a zippered opening for accessing items within the cavity of the compartment.

A golfer will typically access items within the golf bag compartments numerous times during play, having to open and then close the zipper each time. Sometimes, through carelessness or inattention, a golfer forgets to close the zipper opening to a compartment. With a compartment open, there is substantial risk that items within the compartment will fall out, particular as the golfer travels the golf course.

It should be appreciated that there remains a need for a golf bag having compartments that addresses these concerns. The present invention fulfills this need and others.

SUMMARY OF THE INVENTION

In general terms, the present invention provides a golf bag having a bag body and a pocket that includes magnetic assemblies that cooperate with one another to hold the pocket together in a closed configuration. The magnetic assemblies are disposed along first and the second edges, respectively, such that the first and the second magnetic assemblies cooperate with one another to hold the edges together in a closed configuration. The first and the second magnetic assemblies each having an elongate configuration disposed about the corresponding edge.

By way of example, and not limitation, the pocket further includes first and second edges aligned with one another defining an opening for a compartment accessible on a bag body of the golf bag. The pocket further includes first and second magnetic assemblies disposed along the first and the second edges. The first and the second magnetic assemblies can each include a plurality of magnets. For example, the magnetic assemblies can each include a sleeve that confines the plurality of magnets in end-to-end, spaced-apart relationship.

In a detailed aspect of an exemplary embodiment of the invention, the first edge and the second edge each include spaced-apart portions and a transverse portion extending between the spaced-apart portions.

In a detailed aspect of an exemplary embodiment of the invention, the pocket further includes a pocket sidewall coupled to the side of the bag body. The pocket sidewall including the first side edge, and a pocket front wall aligned with the pocket sidewall, the pocket front wall including the second side edge. A lower portion of the pocket front wall is attached to the pocket sidewall. The pocket front wall includes a tab attached proximate to an upper portion thereof and configured to project out to aid a user in decoupling the first and the second magnetic assemblies to open the pocket.

In another detailed aspect of an exemplary embodiment of the invention, the pocket sidewall includes a first wall portion having a first end and a second end and defining a first peripheral side of the pocket, and a second wall portion extending between the first end and the second end of the first wall portion about the periphery of the pocket, wherein the height of first wall portion is greater than the height of the second wall portion.

In yet another detailed aspect of an exemplary embodiment of the invention, the pocket front wall is attached to the first wall portion of the pocket sidewall. The first wall portion is angled inwardly towards the cavity of the pocket such that the front wall is urged to the closed configuration. The pocket front wall includes a tab attached proximate to an upper portion thereof and configured to project out to aid a user in decoupling the first and the second magnetic assemblies to open the pocket.

In yet another detailed aspect of an exemplary embodiment of the invention, barriers extend between the pocket front wall and the pocket sidewall along sides thereof. The barriers can further include a fold line generally aligned with the first and the second edges, such that the barriers fold into the pocket cavity with the pocket in a closed configuration.

In yet another detailed aspect of an exemplary embodiment of the invention, the golf bag includes a gusset disposed between the first and the second edges of the pocket, enabling expansion of a pocket with the first and the second magnetic assemblies in an open configuration.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
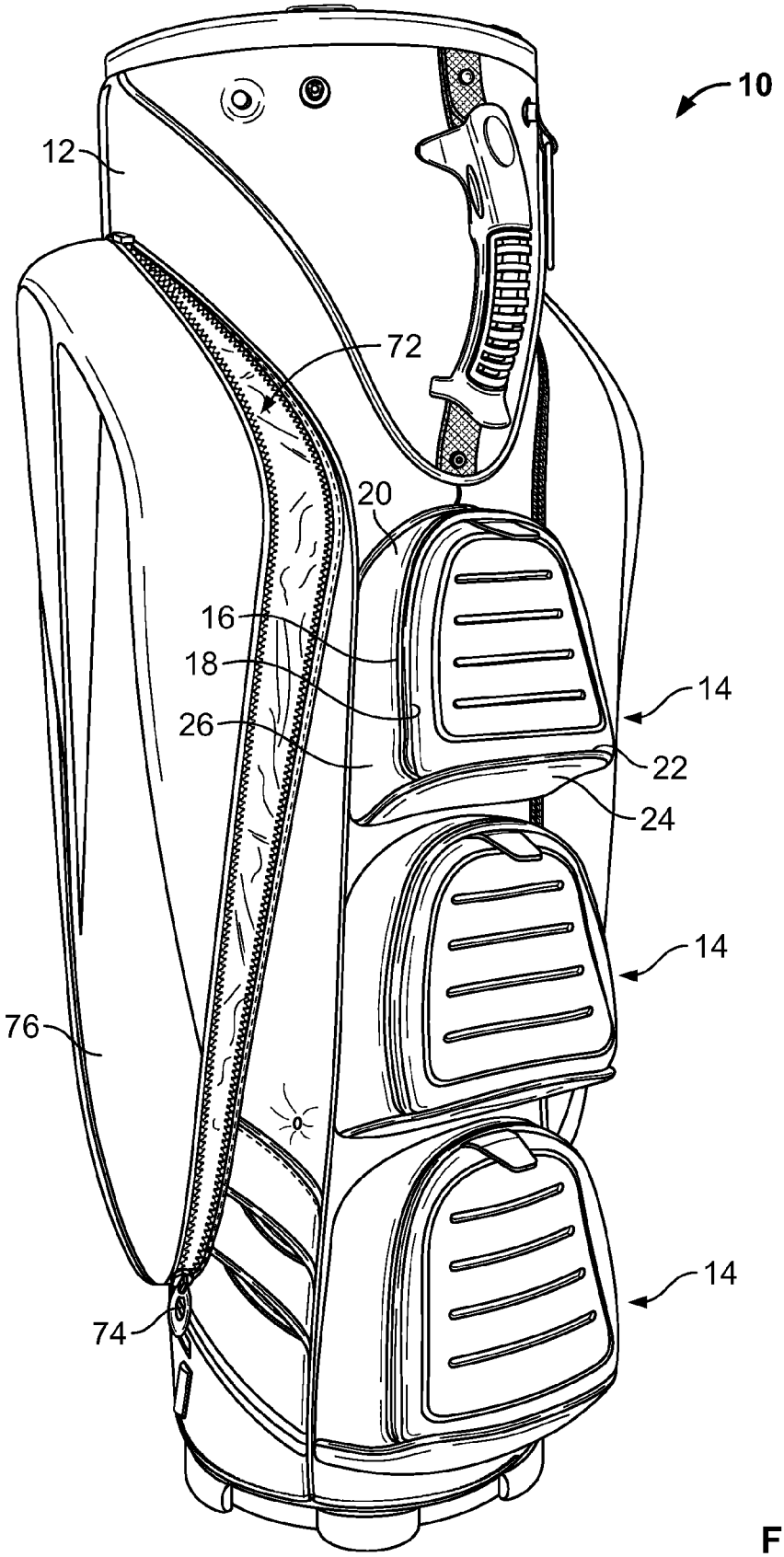
FIG. 1 is a front perspective view of a first embodiment of a golf bag in accordance with the present invention, depicting a plurality of magnetic pockets in a closed configuration.

Referring now to the drawings, and particularly to FIG. 1, there is shown a golf bag 10 having a bag body 12 and a plurality of pockets 14. Each pocket includes magnetic assemblies 16, 18 that cooperate with one another to hold the edges together in a closed configuration. The pocket is configured to allow a user to open it with one hand while accessing contents of the pocket with the other hand. In addition, the pocket is configured to close itself without need of any additional manipulation by the user.

Figure 2:
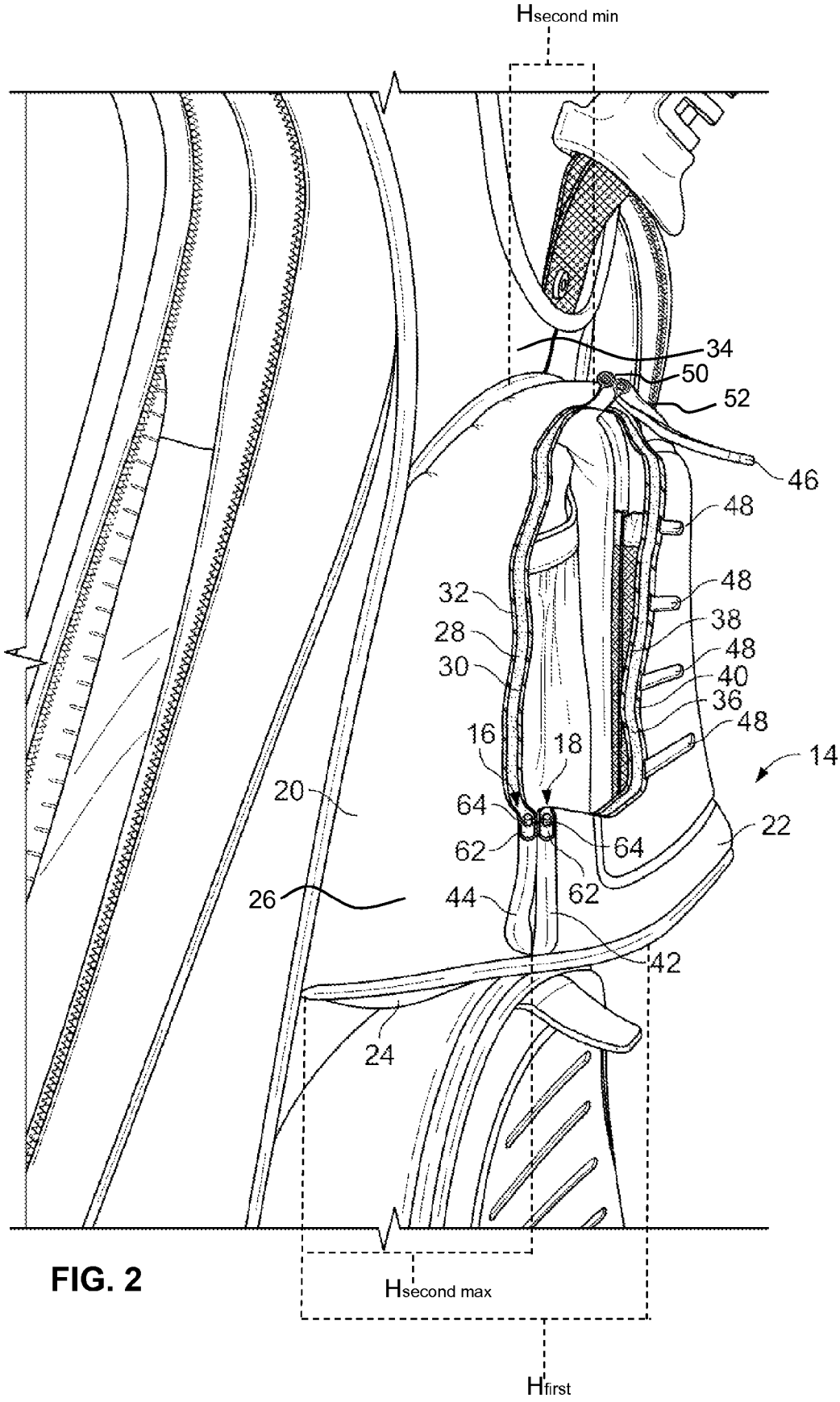
FIG. 2 is a cut-away, perspective view of the upper pocket of the golf bag of FIG. 1, depicting a front wall of the pocket in closed configuration.

Referring to FIG. 2, the pocket 14 includes a pocket sidewall 20 disposed on the bag body 12 and a front wall 22 attached to the sidewall, cooperating to define the pocket cavity. The pocket sidewall generally defines the periphery of the pocket, and includes a first portion 24 that extends across the bottom of the pocket and a second portion 26 that extends around the remaining periphery of the pocket. More particularly, the second portion extends between a first end 28 and a second end 30 of the first portion 24 about the periphery of the pocket.

The second wall portion 26 of the pocket sidewall 20 includes a rigidifying materiel 28 (e.g., cardstock, plastic sheet, or other sturdy material) disposed between a soft material 30 (e.g., felt, cotton, and so on) that defines a inner surface of the second portion and a protective material 32 (e.g., vinyl, leather, and so on) that defines an outer surface of the second portion. The second portion is generally transverse to a sidewall 34 of the bag body 12, whereas the first portion 24 of the pocket sidewall is angled inward relative to the cavity of the pocket. As shown in FIG. 2, the height ($H_{first}$) of first portion 24 of the pocket sidewall is greater than the height ($H_{second\ max}$, $H_{second\ min}$) of the second portion.

The front wall 22 is attached to the first portion 24 of the pocket sidewall 20. The front wall includes a rigidifying material 36 (e.g., cardboard, plastic sheet, or other sturdy material) disposed between a soft material 38 (e.g., felt, cotton, and so on) that defines an inner surface of the front wall, and a protective material 40 (e.g., leather, vinyl, and so on) that defines an outer surface of the front wall. The front wall further includes piping 42 formed of elastic material disposed about the periphery of the front wall. The piping holds the second magnetic assembly 18 in place. The pocket sidewall 20 further includes piping 44 on the second portion thereof, which holds the first magnetic assembly 16.

The pocket front wall 22 includes a tab 46 attached proximate to an upper portion of the front wall. The tab projects out to aid a user in decoupling the first and the second magnetic assemblies 16, 18 to open the pocket. The front wall 22 further includes a plurality of inset creases 48. The creases provide lines of weakening to facilitate bending of the front wall as it opens. The creases further provide convenient support for a user's fingers while opening the pocket. For example, to open the pocket, a user can grasp the tab between the thumb and forefinger to pull the tab, while using the second and/or third fingers as a pivot point against the front wall. This enables the user to open the pocket with one hand, easily, while accessing the contents within the pocket with another.

As the pocket is opened, the front wall 22 applies downward force on the first portion 24 of the pocket sidewall 20. Once the front wall is released, the first portion of the sidewall urges the front wall back in place. This, along with the attractive force between the magnetic assemblies (16, 18) causes the front wall to return to a closed position, without need of any additional manipulation by the user, allowing the pocket to close itself automatically.

With reference again to FIG. 2, the pocket sidewall defines a first edge 50. The first magnetic assembly 16 disposed about the first edge. The front wall has an edge, i.e. second edge 52, that is aligned the first edge. The second magnetic assembly 18 is disposed about the second edge such that cooperating with the first magnetic assembly to secure the pocket front wall to the pocket sidewall.

Figure 3:
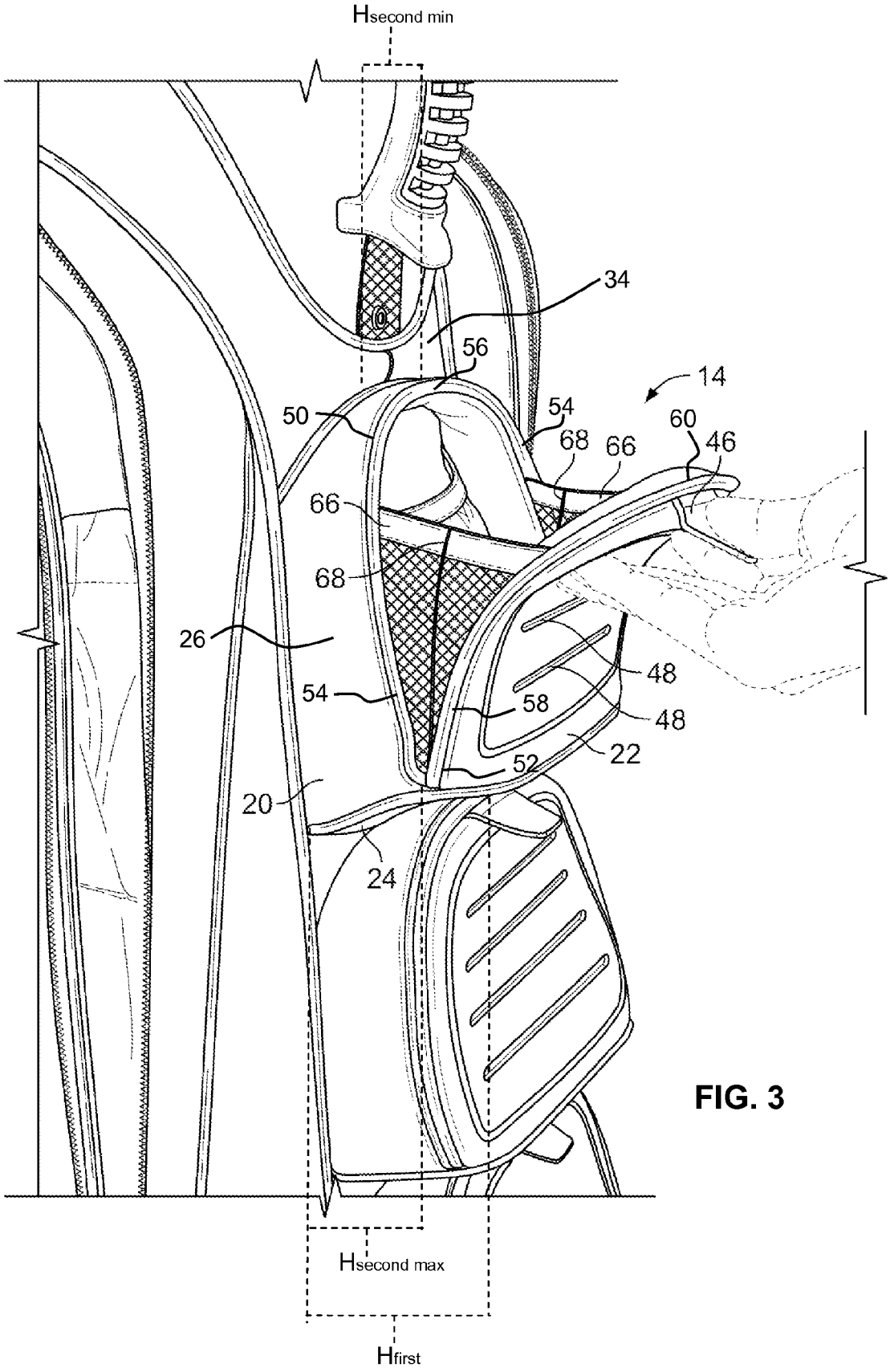
FIG. 3 is a perspective view of the upper pocket of the golf bag of FIG. 1, depicting a front wall of the pocket in an open configuration.

With reference to FIG. 3, the first edge 50 includes two spaced-apart longitudinal side portions 54 and an upper portion 56 disposed along the periphery of the pocket sidewall, and the second side edge 44 includes two spaced-apart longitudinal side portions 58 and an upper portion 60 disposed along the periphery of the front wall 22.

With reference to FIGS. 2 and 3, the magnetic assemblies 16, 18 each include a sleeve 62 that confines the plurality of magnets 64 in end-to-end, spaced-apart relationship. In the exemplary embodiment, the sleeve is formed of a shrink-wrap material (e.g., heat shrink). During manufacture, the magnets are disposed in the sleeve with prescribed spacing, and then exposed to a heat source, which causing the sleeve to contract about the magnets securing them in place, in spaced-apart relationship to one another. In the present example, the magnet assemblies are each formed as a single sleeve housing plurality of magnets that extends substantially the entire length of their respective edges (50, 52). However, other configurations for the magnet assemblies can be used. For example, a magnet assembly can include two or more sleeve/magnets configurations, one or more elongate magnets, or one or more magnets can be securing in material piping disposed about the pocket, to name a few.

The pocket 12 further includes barriers 66 that extend between the pocket front wall 22 and the pocket sidewall 20 along the sides thereof. The barriers each having a fold line 68 generally aligned with the first and the second edges, such that the barriers fold into the pocket cavity with the pocket in a closed configuration. The barriers include a mesh material and can further include elastic material to urge the front wall 22 closed.

Figure 4A:
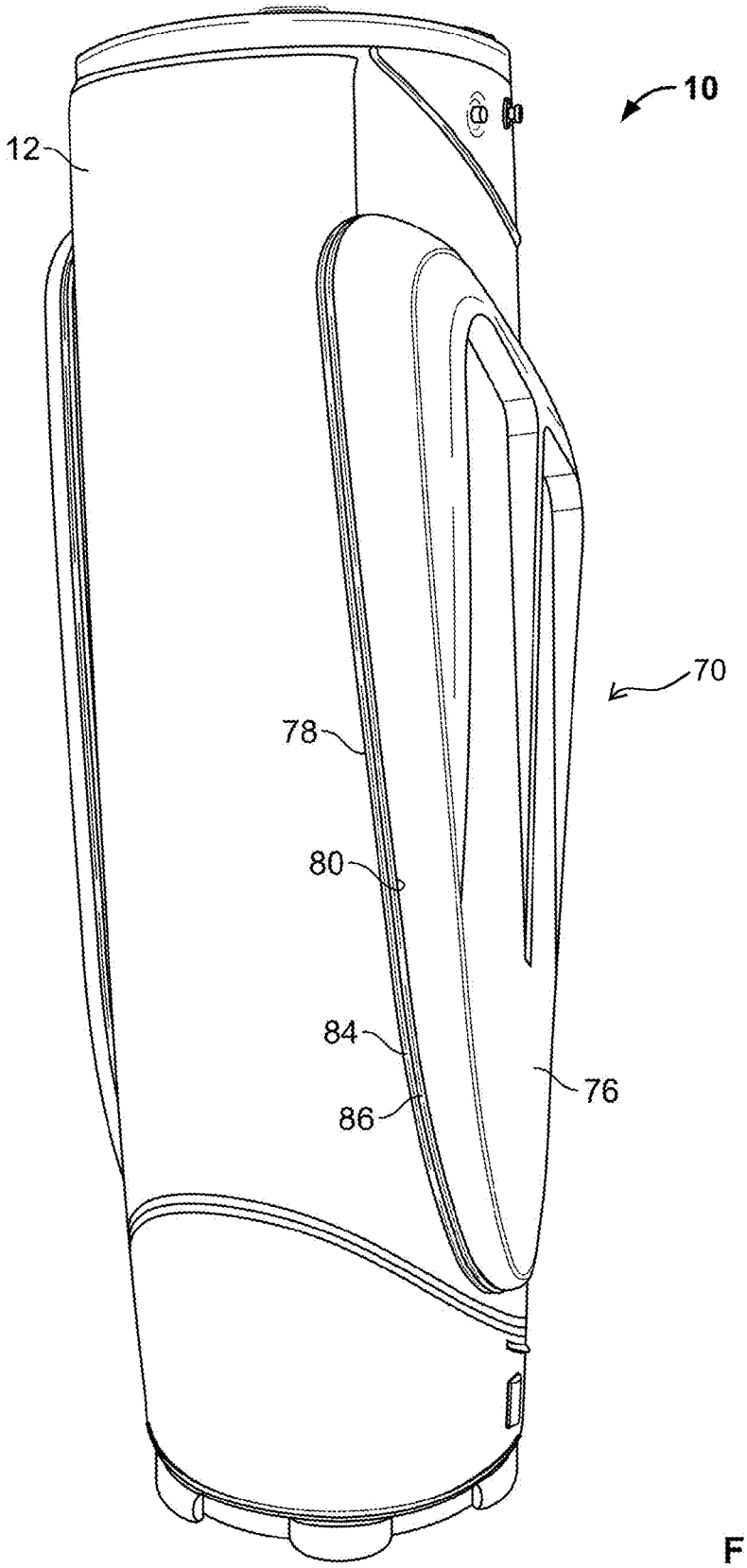
FIG. 4A is a back perspective view of the golf bag of FIG. 1, depicting a side pocket having an expansion gusset in a closed configuration.
Figure 4B:
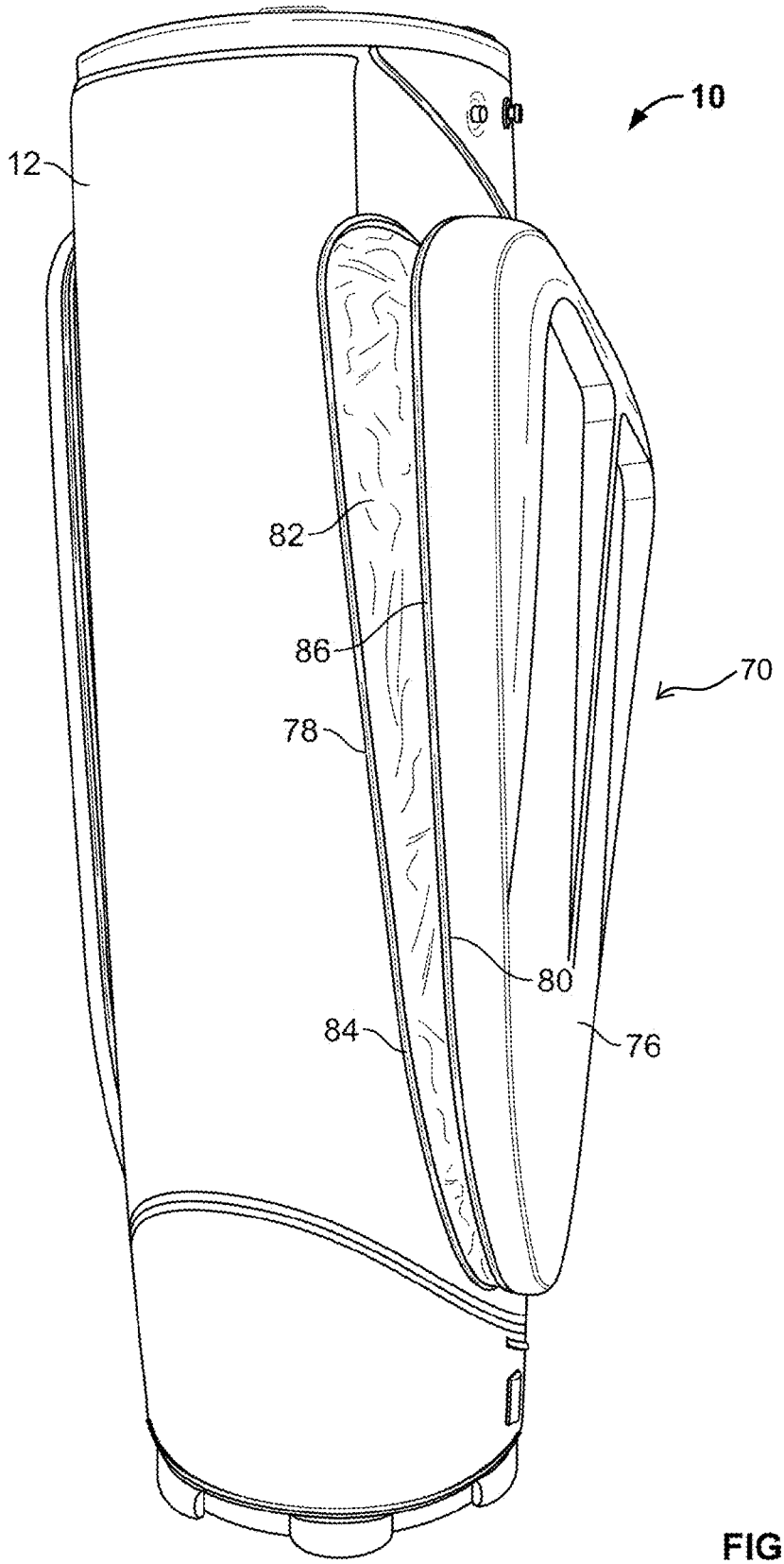
FIG. 4B is a back perspective view of the golf bag of FIG. 1, depicting a side pocket having an expansion gusset in an expanded configuration.

With reference now to FIGS. 4A and 4B, the golf bag 10 further includes a side pocket 70 having an opening 72 and magnetic expansion function. The opening is operable by a zipper 74 (FIG. 1) that couples a side panel 76 to the bag body 12. The zipper extends about a portion of the periphery of the side panel. The side pocket further includes first and second magnetic assemblies 78, 80 that enable an expandable capacity for the side pocket via an expansion gusset 82 connected to the side panel and the bag body 12. The first and the second magnetic assemblies 78, 80 are disposed along corresponding edges 84, 86 of the bag body and the side panel and are similarly configured as discussed above.

In a closed configuration, as shown in FIG. 4A, the first and the second magnetic assemblies are coupled together, keeping the edges 84, 86 of the bag body and the side panel in contact. In an opening configuration, as shown in FIG. 4B, the edges of the bag body and the side panel are spaced apart, which allows the gusset 82 to deploy thereby expanding the capacity of the side pocket 70.

Figure 5:
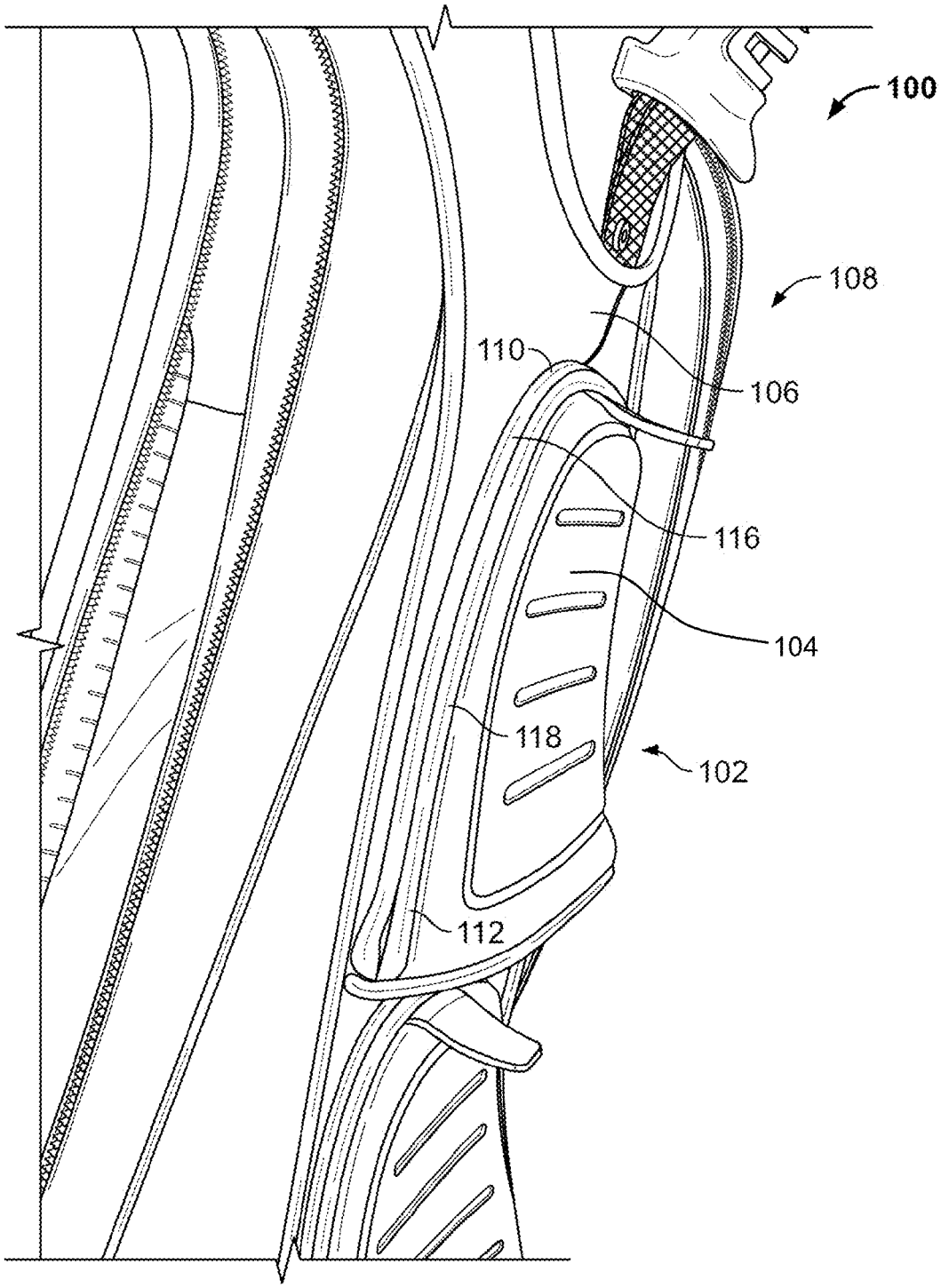
FIG. 5 is a perspective view of a pocket of a second embodiment a golf bag in accordance with the present invention.
Figure 6:
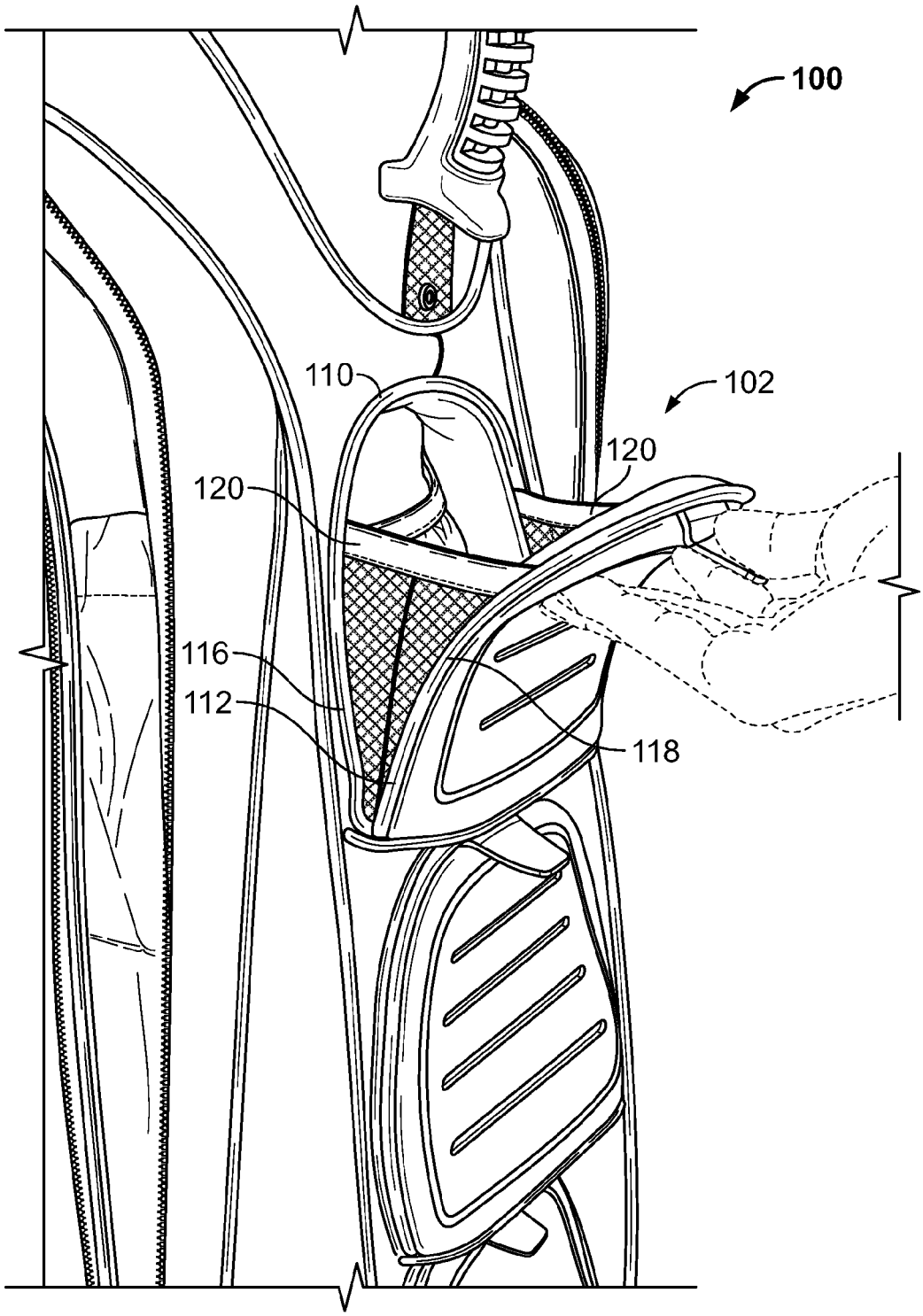
FIG. 6 is a perspective view of the pocket of FIG. 5, depicting the pocket in an open configuration.

With reference now to FIGS. 5 and 6, a second embodiment of a golf bag 100 is shown. In this embodiment, the golf bag includes a pocket 102 having front wall 104 attached to a sidewall 106 of a bag body 108 of the golf bag. The sidewall defines a first edge 110, and the front wall 104 defines a second edge 112 that is aligned with the first edge to aid in defining an opening for a cavity of the pocket. The pocket further includes first and second magnetic assemblies 116, 118 disposed along the first and the second edges, respectively. The first and the second magnetic assemblies cooperate with one another to hold the edges together in a closed configuration.

Figure 7:
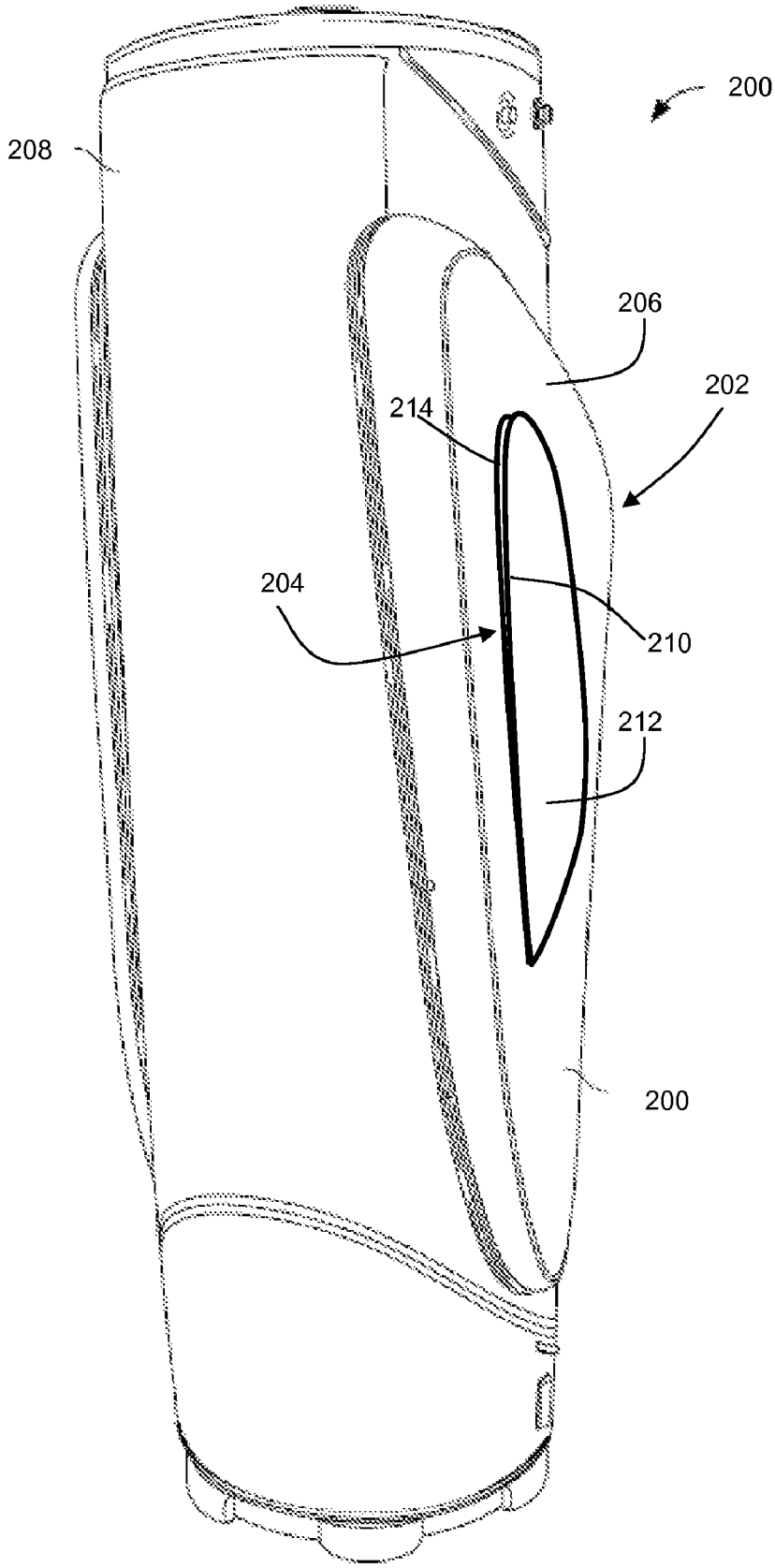
FIG. 7 is a perspective view of a pocket of a third embodiment a golf bag in accordance with the present invention.

With reference now to FIG. 7, a third embodiment of a golf bag 200 is shown. The golf bag includes a side pocket 202 and a second pocket 204 disposed on a side panel 206 of the side pocket. In this embodiment, an opening of the side pocket is operable by a zipper (not shown) that couples the side panel to the bag body 208. The zipper extends about a portion of the periphery of the side panel, similar to the side pocket configuration of the first embodiment (e.g., FIG. 1). In other embodiments, magnetic assemblies can be used for the opening, as well as, for expansion functionality as discussed above.

The second pocket 204 is disposed on the side panel and includes an opening defined by first magnetic assembly 210 disposed on an edge of an outer panel 212 and a second magnetic assembly 214 disposed on the side panel 206. The first and the second magnetic assemblies cooperate with one another to hold the edges together in a closed configuration. In the exemplary embodiment, the first and the second magnetic assemblies each include a plurality of generally flat magnets, providing a smooth, unobtrusive opening to the second pocket.

It should be appreciated from the foregoing that the present invention provides a golf bag having a pocket that includes magnetic assemblies that cooperate with one another to hold the pocket together in a closed configuration. In addition, the pocket is configured to close itself without need of any additional manipulation by the user. The pocket can further include first and second edges aligned with one another defining an opening for a compartment accessible on a bag body of the golf bag. The pocket can further include first and second magnetic assemblies disposed along the first and the second edges. The first and the second magnetic assemblies can each include a plurality of magnets. For example, the magnetic assemblies can each include a sleeve that confines the plurality of magnets in end-to-end, spaced-apart relationship.

Although the invention has been disclosed in detail with reference only to the exemplary embodiments, those skilled in the art will appreciate that various other embodiments can be provided without departing from the scope of the invention. Accordingly, the invention is defined only by the claims set forth below.

What is claimed is:

1. A golf bag, comprising:

a bag body defining an upper opening for receiving golf clubs and a bottom end;

a pocket sidewall disposed on the bag body and defining a cavity, the pocket sidewall having a first wall portion extending across a bottom of the pocket sidewall and a second wall portion extending about the remaining periphery of the pocket sidewall, the first wall portion angled inwardly towards the cavity, the first wall portion having a maximum height greater than a maximum height of the second wall portion, and the second wall portion defining a first edge and having a first magnetic assembly disposed about the first edge, the first magnetic assembly having an elongate configuration, the second wall portion having a height profile that tapers down from a junction of the first wall portion and the second wall portion to an intermediate section of the second wall portion; and a pocket front wall about the periphery of the pocket and having a second edge aligned with the first edge and having a second magnetic assembly disposed about the second edge, the second magnetic assembly having an elongate configuration and cooperating with the first magnetic assembly to secure the pocket front wall to the pocket sidewall, wherein the pocket front wall is attached to the first wall portion of the pocket sidewall such that the first wall portion urges the pocket front wall to a closed configuration independent of the magnetic attraction of the magnetic assemblies.

2. A golf bag as defined in claim 1, further comprising a first barrier that extends between the pocket front wall and the pocket sidewall along a first side thereof, and a second barrier that extends between the pocket front wall and the pocket sidewall along a second side opposite the first side.

3. A golf bag as defined in claim 2, the first barrier and the second barrier each having a fold line generally aligned with the first and the second edges, such that the barriers fold into the pocket cavity with the pocket in a closed configuration.

4. A golf bag as defined in claim 1, wherein the first wall portion extends outwardly from the bag body.

5. A golf bag as defined in claim 1, wherein the first edge extends substantially the entire length of the second wall portion, and the second edge is substantially the same length as the first edge.

6. A golf bag as defined in claim 1, wherein the magnetic assemblies each include a sleeve that confines a plurality of magnets in spaced-apart relationship.

7. A golf bag, comprising:

a bag body defining an upper opening for receiving golf clubs and a bottom end;

a pocket sidewall disposed on the bag body and defining a cavity, the pocket sidewall having a planar first wall portion extending across a bottom of the pocket sidewall and a curved second wall portion extending about the remaining periphery of the pocket sidewall, the planar first wall portion angled inwardly towards the cavity, the first wall portion having a maximum height greater than a maximum height of the second wall portion, and the curved second wall portion the first portion of the sidewall defining a first edge and having a first magnetic assembly disposed about the first edge, the first magnetic assembly having an elongate configuration; and a planar pocket front wall having rigidifying material disposed therein and a second edge aligned with the first edge and having a second magnetic assembly disposed about the second edge, the second magnetic assembly having an elongate configuration and cooperating with the first magnetic assembly to secure the pocket front wall to the pocket sidewall, wherein the pocket front wall is attached to the first wall portion of the pocket sidewall such that the first wall portion urges the pocket front wall to a closed configuration independent of the magnetic attraction of the magnetic assemblies.

8. A golf bag as defined in claim 7, further comprising a first barrier that extends between the pocket front wall and the pocket sidewall along a first side thereof, and a second barrier that extends between the pocket front wall and the pocket sidewall along a second side opposite the first side.

9. A golf bag as defined in claim 8, the first barrier and the second barrier each having a fold line generally aligned with the first and the second edges, such that the barriers fold into the pocket cavity with the pocket in a closed configuration.

10. A golf bag as defined in claim 7, wherein the planar pocket front wall defines a plurality of creases on an outer surface thereof.

11. A golf bag as defined in claim 7, wherein the first edge extends substantially the entire length of the second wall portion, and the second edge is substantially the same length as the first edge.

12. A golf bag as defined in claim 7, wherein the magnetic assemblies each include a sleeve that confines a plurality of magnets in spaced-apart relationship.

13. A golf bag, comprising:

a bag body defining an upper opening for receiving golf clubs and a bottom end, the bag body defining a longitudinal axis;

a pocket sidewall disposed on the bag body and defining a cavity, the pocket sidewall having a planar first wall portion extending across a bottom of the pocket sidewall and a curved second wall portion extending about the remaining periphery of the pocket sidewall, the planar first wall portion angled inwardly towards the cavity, the first wall portion having a maximum height greater than a maximum height of the second wall portion, and the curved second wall portion defining a first edge including a first magnetic assembly disposed about the first edge, the first magnetic assembly having an elongate configuration, the second wall portion slopes from a maximum height proximate to the first wall portion to an intermediate region of the second wall portion located on an opposing side of the pocket relative to the first wall portion, and a planar front wall attached to the first wall portion of the pocket sidewall, the front wall having rigidifying material disposed therein and a second edge aligned with the first edge of the pocket sidewall having a second magnetic assembly disposed about the second edge, the second magnetic assembly having an elongate configuration and cooperating with the first magnetic assembly to secure the pocket front wall to the pocket sidewall, wherein the planar front wall is configured to be oriented at a relatively constant angle relative to the longitudinal axis of the bag body in a closed configuration.

14. A golf bag as defined in claim 13, wherein the magnetic assemblies each include a sleeve that confines a plurality of magnets in spaced-apart relationship.

15. A golf bag as defined in claim 13, the planar pocket front wall defines a plurality of creases on an outer surface thereof.

16. A golf bag as defined in claim 13, wherein the first wall portion extends outwardly from the bag body.

17. A golf bag as defined in claim 13, further comprising a first barrier that extends between the pocket front wall and the pocket sidewall along a first side thereof, and a second barrier that extends between the pocket front wall and the pocket sidewall along a second side opposite the first side.

* * * * *